US006313857B1

(12) United States Patent
Shimizu

(10) Patent No.: US 6,313,857 B1
(45) Date of Patent: Nov. 6, 2001

(54) METHOD FOR CORRECTING DENSITY IRREGULARITY AND IMAGE RECORDING APPARATUS USING THE METHOD

(75) Inventor: Osamu Shimizu, Shizuoka (JP)

(73) Assignee: Fuji Photo Film Co., Ltd., Kangawa (JP)

( * ) Notice: Subject to any disclaimer, the term of this patent is extended or adjusted under 35 U.S.C. 154(b) by 0 days.

(21) Appl. No.: 09/206,288

(22) Filed: Dec. 7, 1998

(30) Foreign Application Priority Data

Dec. 8, 1997 (JP) ..... 9-337190

(51) Int. Cl.[7] ..... B41J 2/36
(52) U.S. Cl. ..... 347/188; 347/19
(58) Field of Search ..... 347/188, 19; 400/120.09; 358/461

(56) References Cited

U.S. PATENT DOCUMENTS

| | | | | |
|---|---|---|---|---|
| 5,202,773 | | 4/1993 | Kato . | |
| 5,886,724 | * | 3/1999 | Kuwabara et al. | 347/188 |
| 5,973,712 | * | 10/1999 | Agano | 347/188 |
| 6,018,355 | * | 1/2000 | Kuwabara | 347/188 |

FOREIGN PATENT DOCUMENTS

| | | | | |
|---|---|---|---|---|
| 0 453 714 A1 | | 2/1990 | (EP) . | |
| 0 399 668 A2 | | 11/1990 | (EP) . | |
| 0 604 941 A2 | | 12/1992 | (EP) . | |
| 0 663 296 A1 | | 7/1995 | (EP) . | |
| 0 743 195 A1 | | 11/1996 | (EP) . | |
| 10-286986 | * | 10/1998 | (JP) | 347/188 |

* cited by examiner

*Primary Examiner*—Huan Tran
(74) *Attorney, Agent, or Firm*—Sughrue, Mion, Zinn, Macpeak & Seas, PLLC

(57) ABSTRACT

A belt-like pattern, or the like, is printed at a predetermined-gradation value in the first main scanning direction of the line head 66 (S1); a scanner 51 is relatively moved along the first main scanning direction of the line head 66 while aligning the second main scanning direction of the scanner 51 with the subsidiary scanning direction of the line head 66 to thereby detect printing density of the belt-like pattern, or the like (S2); a correction condition for each pixel position on the basis of the detected printing-density value and the predetermined-gradation value is obtained (S5); and image data for image recording is corrected on the basis of the obtained correction condition (S9). Thus, a density irregularity correction method can be provided for correcting density irregularity accurately without influence of individual sensitivity of scanners of an image recording apparatus using the methods.

12 Claims, 8 Drawing Sheets

FIG.11
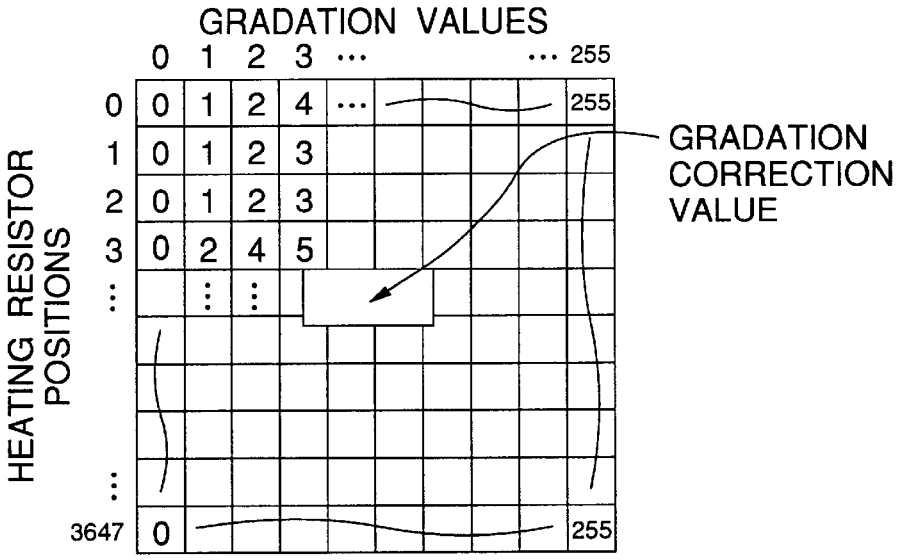
FIG.12
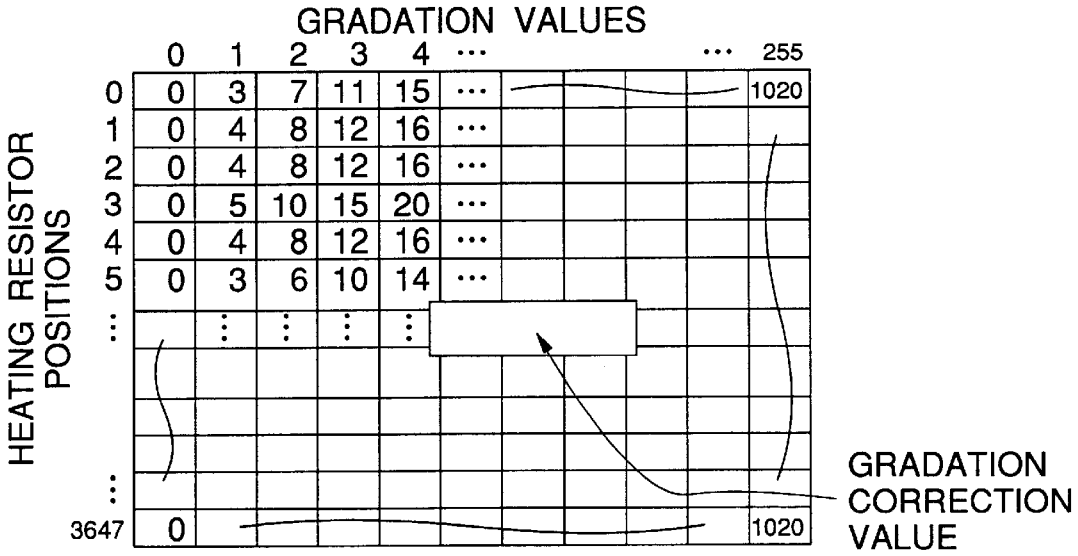
FIG.13
| q \ p | 0 | 1 | 2 | 3 |
|---|---|---|---|---|
| 0 | 0 | 3 | 1 | 2 |
| 1 | 3 | 2 | 0 | 1 |
| 2 | 1 | 0 | 2 | 3 |
| 3 | 2 | 1 | 3 | 0 |

METHOD FOR CORRECTING DENSITY IRREGULARITY AND IMAGE RECORDING APPARATUS USING THE METHOD

BACKGROUND OF THE INVENTION

The present invention relates to a technique for correcting recording density irregularity in image recording by using a line head.

To prepare a printing plate from a color sheet of manuscript to thereby perform printing on a large number of sheets of paper, proof printing is performed and then final printing is performed after the finished state of the proofs is checked. In the proof printing process, a color proof is produced and the image quality of the color proof is checked. The color proof is obtained by the steps of: thermally transferring an image to a receiver sheet by a thermal printer; and transferring the image formed on the receiver sheet to a sheet of paper.

As is known well, in an image recording apparatus such as a thermal printer, or the like, while a glaze formed by arrangement of heating resistors corresponding to one-line's pixels in one direction (a first main scanning direction) is relatively moved, together with a printing medium, in the subsidiary scanning direction substantially perpendicular to the direction of the arrangement of the heating resistors in the condition that the glaze is slightly pressed against the printing medium, the respective heating resistors in the glaze are heated in accordance with image data of a recording image. As a result, an image is thermally transferred to the printing medium to thereby form a recording image.

In the image recording apparatus using the aforementioned recording method, when, for example, a recording image is formed by use of image data having one and the same predetermined-gradation value, recording density irregularity such as shading, or the like, in which the density of the formed recording image varies in accordance with the heating resistors, may occur. This is inevitable because the shape of the glaze of the line head is not always uniform. In some image processing apparatus, density irregularity correction is performed for image data in advance to prevent lowering of image quality caused by density irregularity.

A specific example of the density irregularity correction method is the following method.

First, an image is recorded on the basis of image data having a uniform gradation in the first main scanning direction of the line head. The thus recorded image is scanned by a densitometer such as a scanner, or the like, moving relatively in the subsidiary scanning direction of the line head to thereby detect printing density. The printing density obtained for each pixel is compared with the gradation value of the image data to thereby correct the gradation value of the image data.

In the conventional density irregularity correction method described above, however, printing densities in different positions of the recording image are detected individually by detection elements of the scanner. Accordingly, the printing-density value may vary in accordance with the individual sensitivity characteristic of the detection elements of the scanner. Generally, the sensitivity characteristic of the detection elements of the scanner is not uniform in the strict sense, so that printing densities to be detected as the same value originally are detected as different density values. As a result, the correction values which are set on the basis of the detected printing-density values become incorrect. There arises a problem that appropriate density irregularity correction cannot be made.

SUMMARY OF THE INVENTION

The present invention is designed to provide density irregularity correction methods for correcting density irregularity accurately without influence of individual sensitivity characteristic peculiar to a scanner of an image recording apparatus.

In order to achieve the above object, according to an aspect of the present invention, provided is a method for correcting density irregularity in image recording using a line head, by comprising the steps of: printing a belt-like pattern at a predetermined-gradation value in the first main scanning direction of the line head; relatively moving a line sensor along the first main scanning direction of the line head while aligning a second main scanning direction of the line sensor, which is corresponding to a scanning direction of said line sensor, with the subsidiary scanning direction of the line head to thereby detect printing density of the belt-like pattern; obtaining a correction condition for each pixel position on the basis of the detected printing-density value and the predetermined-gradation value; and correcting image data for image recording on the basis of the correction condition.

Preferably, in the above method, the belt-like pattern includes a plurality of belt-like pattern portions printed at least two gradation values selected in the proximity of the predetermined-gradation value; and averages of printing-density values are obtained for the plurality of belt-like pattern portions respectively and the correction condition is set on the basis of the change ratios of the obtained averages of printing-density values to the gradation values of the belt-like pattern portions.

For example, in the case of belt-like pattern portions printed at two gradation values, a correction condition is set on the basis of the ratio of the difference between averages of printing-density values to the difference between the gradation values. In the case of belt-like pattern portions printed at three or more gradation values, the distribution of printing-density values for the gradation values is subjected to linear approximation, or the like, to obtain change ratios, so that correction conditions are set on the basis of the change ratio.

Preferably, in the above method, the belt-like pattern includes first and second belt-like pattern portions which are printed at a first gradation value as the predetermined-gradation value and at a second gradation value near to the first gradation value, respectively; and averages of printing-density values are obtained for the first and second belt-like pattern portions respectively and the correction condition is set on the basis of the ratio of the difference between the obtained averages to the difference between the first and second gradation values.

Preferably, in the above method, the predetermined-gradation value is any one of gradation values obtained by division of a gradation range up to the maximum gradation value into a plurality of equal stages; and correction conditions for all gradations are set by interpolation on the basis of individual correction conditions set for the respective stages. For example, in the case of image data of 256 gradations, a range of from 0 to 255 is substantially divided into four equal parts so that five gradation values of 0, 64, 128, 192 and 255 are set. The values of 0 and 255 are not corrected and correction conditions for the gradation values of 64, 128 and 192 are obtained. Correction conditions for gradation values of 0 to 255 are set approximately by interpolation on the basis of the obtained individual correction conditions for the gradation values of 64, 128 and 192.

According to another aspect of the present invention, provided is an image recording apparatus comprising a correction value table storage portion for storing a correction value table for gradation value correction determined on the basis of printing-density values of image patterns printed, an image memory for storing image data corrected on the basis of the correction value table, and an image correction control portion for controlling correction of image data, characterized in that density correction data obtained by a method such as will be shown in this invention are stored in the correction value table storage portion.

Preferably, in the above method, an image is recorded, by a thermal head, on a thermal transfer recording material having a substantially transparent heat-sensitive ink layer, the ink layer containing 30 to 70 parts by weight of pigment and 25 to 60 parts by weight of amorphous organic high-molecular polymer having a softening point of from 40° C. to 150° C., the ink layer having a thickness of from 0.2 $\mu$m to 1.0 $\mu$m, 70% or more of the pigments contained in the heat-sensitive ink layer having particle sizes not larger than 1.0 $\mu$m, optical reflection density of a transfer image being not lower than 1.0 when the thermal transfer recording material is formed on a white support.

BRIEF DESCRIPTION OF THE DRAWINGS

FIG. 11 is a view showing data on a correction value table;

FIG. 12 is a view showing intermediate data on the correction value table;

FIG. 13 is a view showing data in an addition value matrix.

DETAILED DESCRIPTION OF THE PREFERRED EMBODIMENTS

Embodiments of correcting recording density irregularity in image recording according to the present invention will now be described with reference to the drawings.

Figure 1:
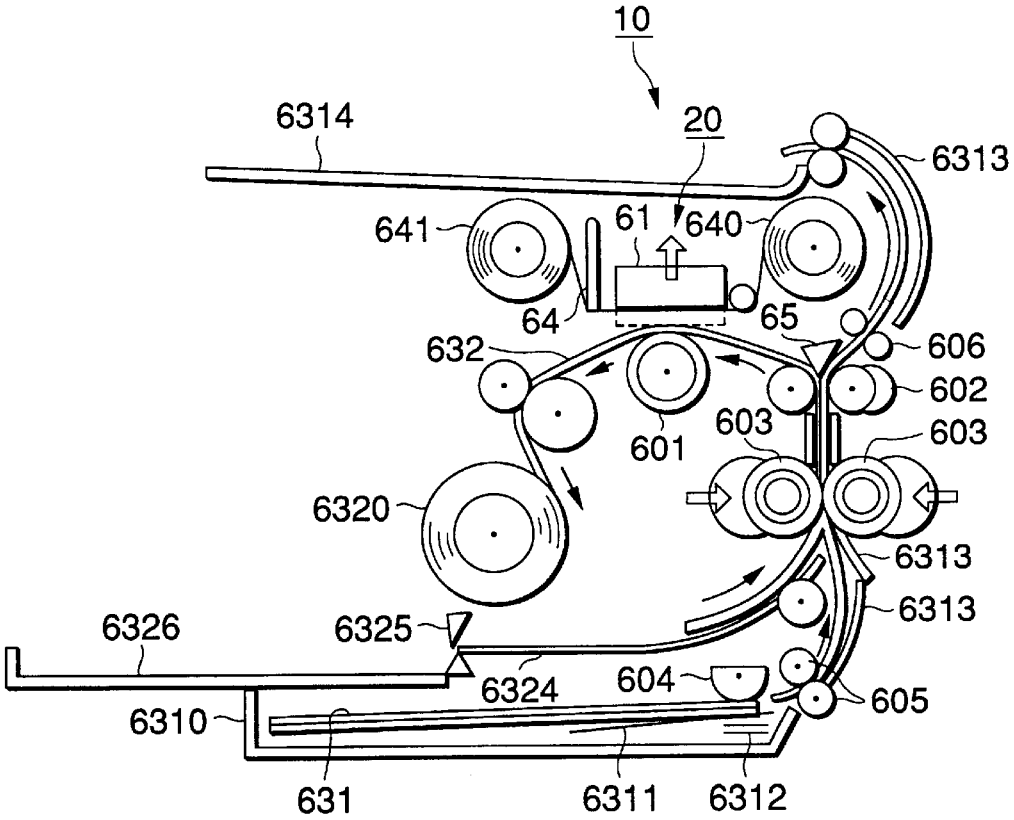
FIG. 1 is a conceptual view showing the configuration of an image recording apparatus accord of modes for carrying out the present invention.
Figure 2:
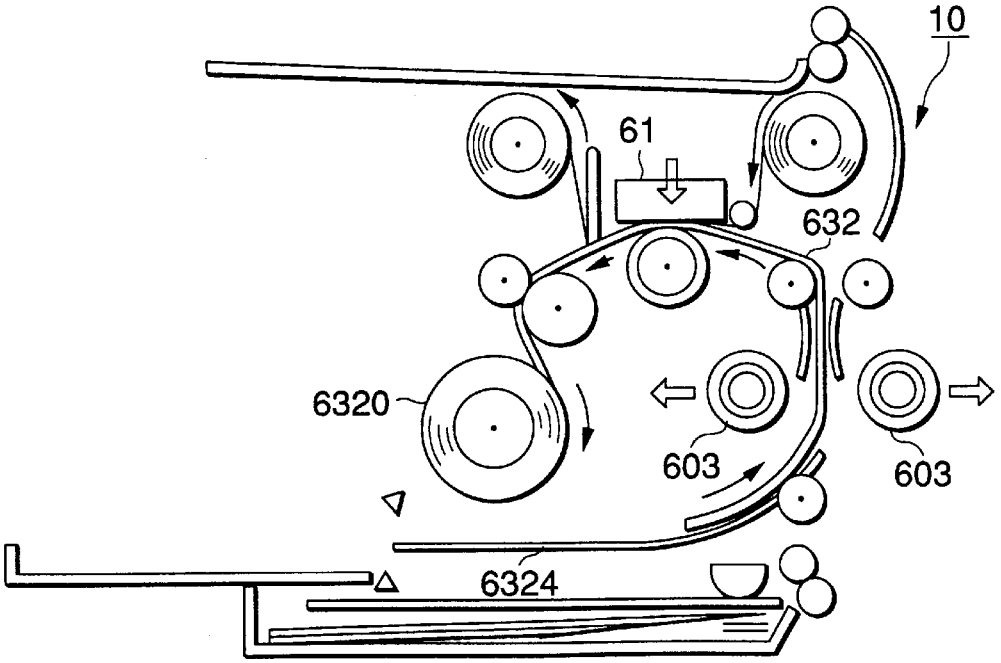
FIG. 2 is an explanatory view of the image recording apparatus depicted in FIG. 1 in the case where a printing operation is performed.
Figure 3:
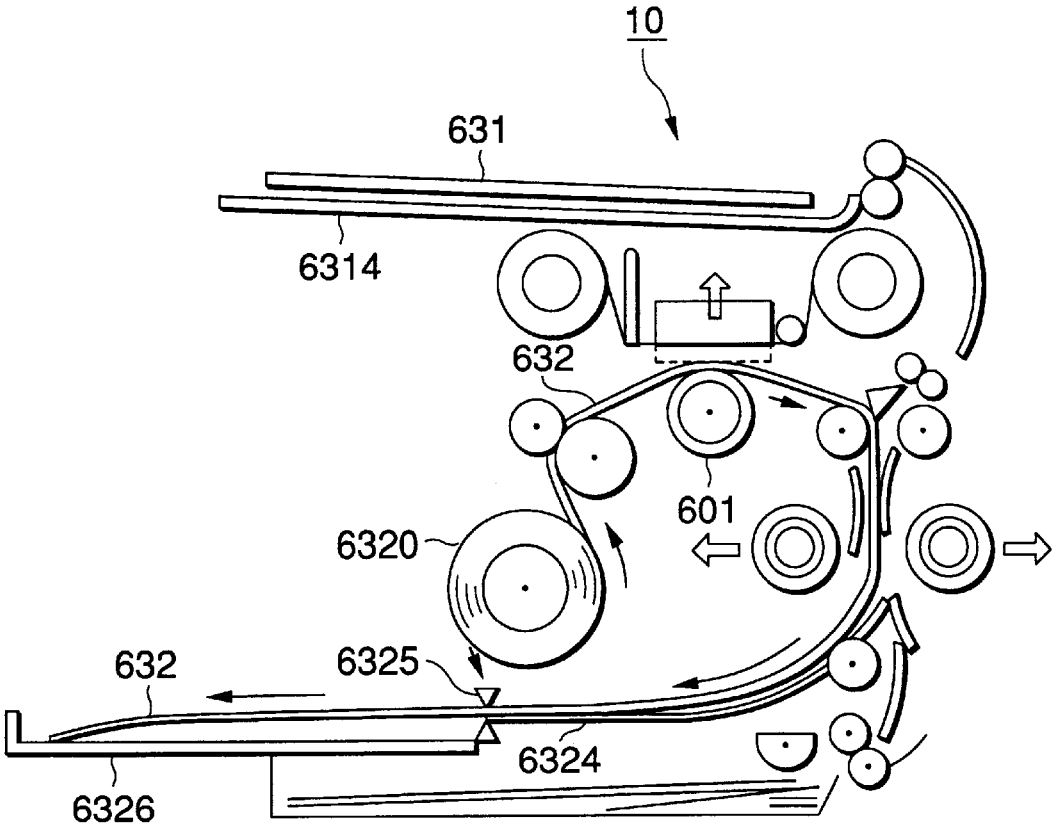
FIG. 3 is an explanatory view of the image recording apparatus depicted in FIG. 1 in the case where a receiver sheet is ejected.

One of modes for carrying out the present invention will be described below with reference to FIGS. 1 through 11. FIG. 1 conceptually shows the main configuration of an image recording apparatus according to a mode for carrying out the present invention; FIG. 2 is an explanatory view of the image recording apparatus depicted in FIG. 1 in the case where a printing operation is carried out; and FIG. 3 is an explanatory view of the image recording apparatus depicted in FIG. 1 in the case where a receiver sheet is ejected.

This image recording apparatus 10 (hereinafter referred to as "recording apparatus 10") is configured as a recording apparatus with a laminator in which a pair of pressing/heating rollers are provided in a sheet carrying path of the recording apparatus. The laminator-including recording apparatus 10 comprises as main constituent members; a platen 601; a thermal head 61 which is a line head having heating elements disposed in opposition to the platen 601; an ink ribbon 64 put between the platen 601 and the thermal head 61 so as to be fed with advance of printing; a receiver sheet supply roll 6320 wound with a receiver sheet 632; a paper supply cassette 6310 containing sheets of paper 631; an ejection tray 6314 for ejecting a sheet of paper 631 after transferring an image to the sheet of paper 631; a withdrawal tray 6326 for withdrawing the receiver sheet 632 after transferring an image to a sheet of paper 631; a pair of pressing/heating rollers 603; and a pair of releasing rollers 602.

A metal plate 6311 urged upward by a spring 6312 is provided in the paper supply cassette 6310 so that the metal plate 6311 urges sheets of paper 631 upward to press the sheets of paper 631 against a pickup roller 604. The uppermost sheet of paper 631 pressed against the pickup roller 604 is put between the pair of pressing/heating rollers 603 by a pair of paper supply rollers 605 when the pickup roller 604 rotates.

The pair of pressing/heating rollers 603 are formed so as to be reversibly rotatable and movable both in a direction of approach of them to each other and in a direction of separation of them from each other. The pair of pressing/heating rollers 603 are designed so as to carry a combination of sheets (the receiver sheet 632 and a sheet of paper 631) while pressing and heating the combination of sheets in the condition that the pair of pressing/heating rollers 603 move to approach each other and to cancel the pressing/heating of the combination of sheets in the condition that the pair of pressing/heating rollers 603 move to separate from each other.

A receiver sheet cutter 6325 is provided in a withdrawal path 6324 between the pair of pressing/heating rollers 603 and the withdrawal tray 6326 so that the receiver sheet cutter 6325 cuts the receiver sheet 632 which is carried to the withdrawal path 6324 after the completion of image transferring.

The operation of the laminator-including recording apparatus 10 configured as described above will be described below.

In printing, as shown in FIG. 2, the receiver sheet 632 is fed out of the supply roll 6320 by the quantity corresponding to one sheet of paper and then an image is printed by the thermal head 61 while the receiver sheet 632 is rewound on the supply roll 6320 in the direction of the arrows shown in FIG. 2. In this occasion, the pair of pressing/heating rollers 603 stand by in the condition that the pair of pressing/heating rollers 603 are moved so as to separate from each other, so that the pair of pressing/heating rollers 603 never touch the receiver sheet 632. In the case of color printing, this sequence is repeated by the number of times corresponding to the number of colors.

For instance, the receiver sheet 632 is a thermal transfer recording material having a substantially transparent heat-sensitive ink layer, which contains 30 to 70 parts by weight of pigment and 25 to 60 parts by weight of amorphous organic high-molecular polymer having a softening point of from 40° C. to 150° C., which has a thickness of from 0.2 μm to 1.0 μm, in which 70% or more of pigments have particle sizes not larger than 1.0 μm, and having optical reflection density of a transfer image being not lower than 1.0 when the thermal transfer recording material is formed on a white support.

To transfer an image to a sheet of paper 631 after completion of printing on the receiver sheet 632, the receiver sheet 632 having the image printed thereon is fed out again by the quantity corresponding to one sheet of paper so that the forward end portion of the receiver sheet 632 is disposed in a neighbor of the insertion position between the pair of pressing/heating rollers 603 at the time of image recording.

Then, a sheet of paper 631 is pulled out from the paper supply cassette 6310 by the pickup roller 604. At the point of time when the forward end of the sheet of paper 631 has passed between the pair of pressing/heating rollers 603, the pair of pressing/heating rollers 603 are moved to approach each other so that the combination of the receiver sheet 632 and the sheet of paper 631 is carried upward in FIG. 1 while both the receiver sheet 632 and the sheet of paper 631 are pressed and heated simultaneously. In this occasion, when the pair of pressing/heating rollers 603 are made to approach each other at the point of time when the forward end of the sheet of paper 631 has passed between the pair of pressing/heating rollers 603, the forward end of the sheet of paper 631 gets in a state in which it does not adhere to the receiver sheet 632.

The forward end of the sheet of paper 631 which does not adhere to the receiver sheet 632 is released by the releasing rollers 602. The sheet of paper 631 thus released from the receiver sheet 632 is ejected to the ejection tray 6314 by a pair of carrying rollers 606 after releasing. Incidentally, when the forward end of a releasing claw 65 is inserted into between the receiver sheet 632 and the sheet of paper 631, the sheet of paper 631 can be released more securely.

At the point of time when a neighbor of the rear end of the sheet of paper 631 has passed between the pair of pressing/heating rollers 603, the pair of pressing/heating rollers 603 separate from each other to return to standby positions.

On the other hand, the receiver sheet 632 is fed out so that a portion of the receiver sheet 632 from which an image has been transferred to the sheet of paper 631 comes to the position of the receiver cutter 6325 as shown in FIG. 3. The image-transferred portion is cut and withdrawn to the withdrawal tray 6326. Incidentally, the step of feeding out the receiver sheet 632 for the withdrawal serves also as the step of feeding out the receiver sheet 632 for preparation for next printing.

In the feeding-out step, configuration may be made so that the rear heat roller (in the left in the drawings) does not separate. In this case, a portion of the receiver sheet to be subjected to next printing is heated in advance, so that substances in the recording surface of the receiver sheet are stabilized. This brings an effect that recording sensitivity is stabilized.

Further, in the case where the step of transferring an image to the sheet of paper 631 is to be omitted, a non-transferred portion of the receiver sheet 632 can be obtained by the steps of: feeding out the receiver sheet 632 to eject a printed portion of the receiver sheet 632 to the withdrawal tray 6326; and cutting the printed portion of the receiver sheet 632 by the receiver sheet cutter 6325 to eject the non-transferred portion of the receiver sheet 632 to the withdrawal tray 6326.

A recording portion 20 of the recording apparatus 10 will be described below with reference to FIG. 4.

The columnar platen 601 provided in opposition to the thermal head 61 rotates, for example, counterclockwise to carry the receiver sheet 632 and presses both the thermal head 61 and the ink ribbon 64 by a predetermined pressure toward the thermal head 61, so that the ink ribbon 64 is wound up on the take-up side 641 through a guide roller 643.

The receiver sheet 632 to which an image is thermally transferred through the ink ribbon 64 by heating resistors of the thermal head 61, is driven to be carried by a pair of rolls 607 and 608 via the platen 601.

Figure 4:
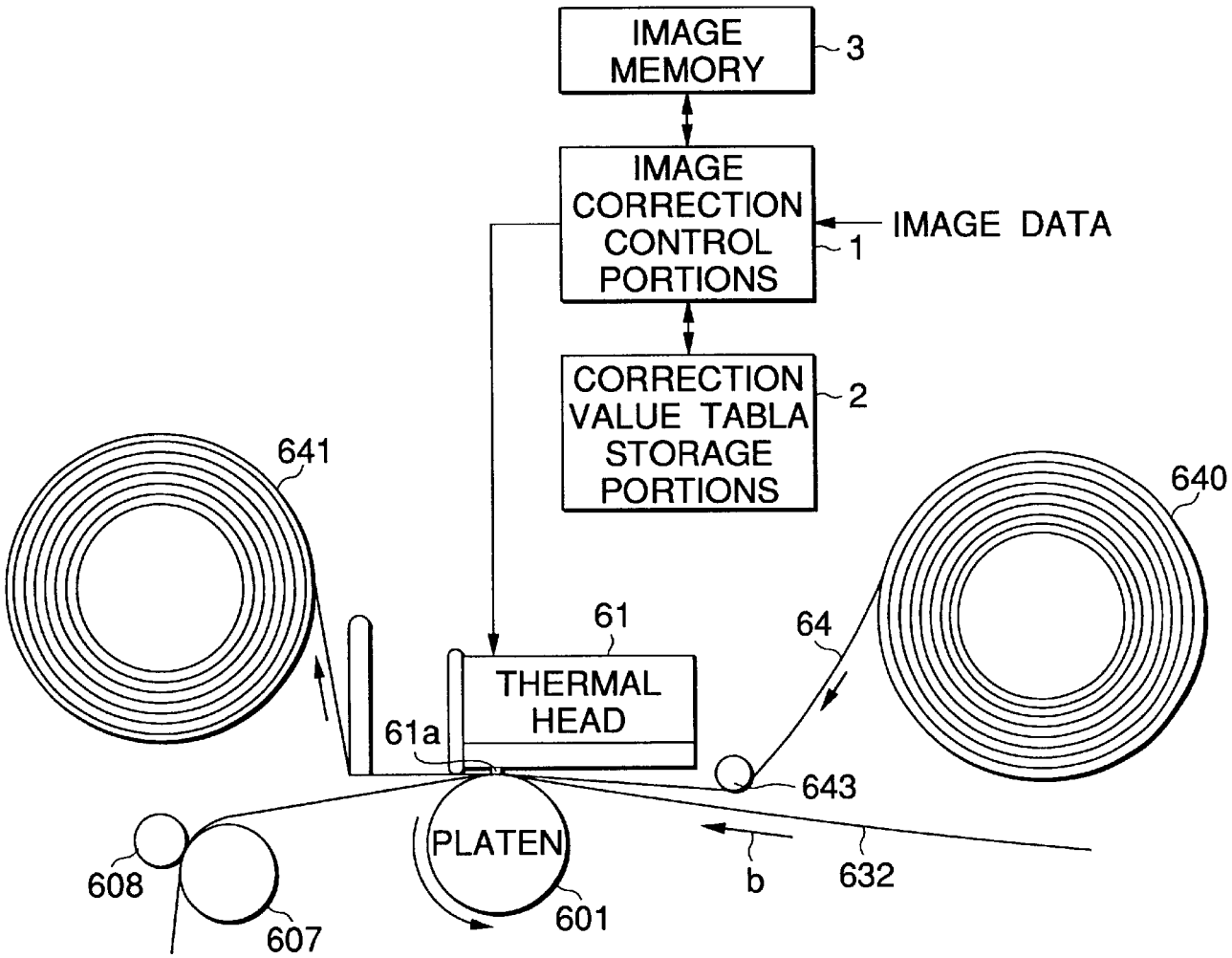
FIG. 4 is a conceptual view showing the configuration of a recording portion of the image recording apparatus according to the mode for carrying out the present invention.

In the thermal head 61 which is, for example, provided to record an image not larger than B4-size (crown quarto) at a recording (pixel) density of about 300 dpi, heating resistors for recording a one-line's portion of the image on the receiver sheet 632 are arrayed in one direction (perpendicular to a plane forming FIG. 4).

The platen 601 rotates at a predetermined image-transfer speed while holding the receiver sheet 632 in a predetermined position to thereby carry the receiver sheet 632 in a direction substantially perpendicular to the direction of extension of glaze 61*a* of the thermal head (that is, in a direction of the arrow b in FIG. 4).

When an image is to be recorded by this recording apparatus, a predetermined transfer start position of the receiver sheet 632 is carried to a position opposite to the glaze 61*a* and then the receiver sheet 632 is carried in the direction of the arrow b by the platen 601 while being aligned with the ink ribbon 64 (in accordance with each of colors Y, M, C and K in the case of a color image).

With the carrying of the receiver sheet 632, the respective heating resistors of the glaze 61*a* are heated in accordance with image data of the recording image to thereby perform transfer recording to the receiver sheet 632. As a result, an image corresponding to the recording image is transferred to the receiver sheet 632. In the case of a color image, monochromatic images are transferred, for example, in order of Y, M, C and K, to the receiver sheet 632 so as to be superposed on one another.

Here, an image data correction control system for correcting image data of the recording image in the recording apparatus according to this mode includes: an image correction control portion 1 for correcting input image data to generate corrected image data; a correction value table storage portion 2 for storing a correction value table for correcting image data; and an image memory 3 for storing the corrected image data.

Figure 5:
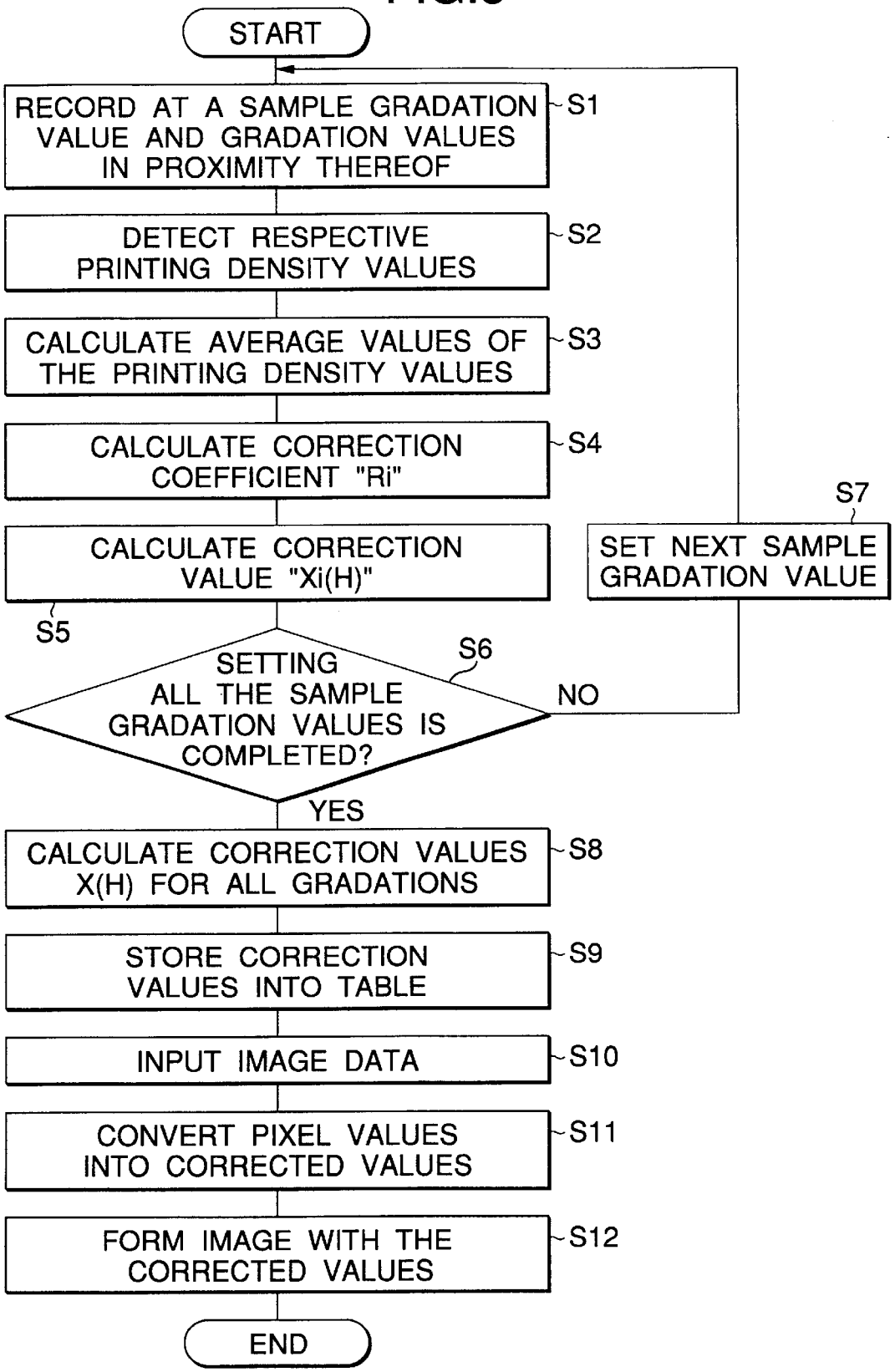
FIG. 5 is a flow chart showing a procedure for correcting density irregularity to form an image.

A method for correcting image data by the aforementioned image data correction control system will be described below with reference to a flow chart shown in FIG. 5. A density irregularity correction method in this mode is schematically to detect printing-density values of image patterns recorded at predetermined-gradation values to thereby determine values for correcting the gradation values of image data on the basis of the ratios of the obtained printing-density values to the gradation values. The detailed procedure will be described below.

Figure 6:
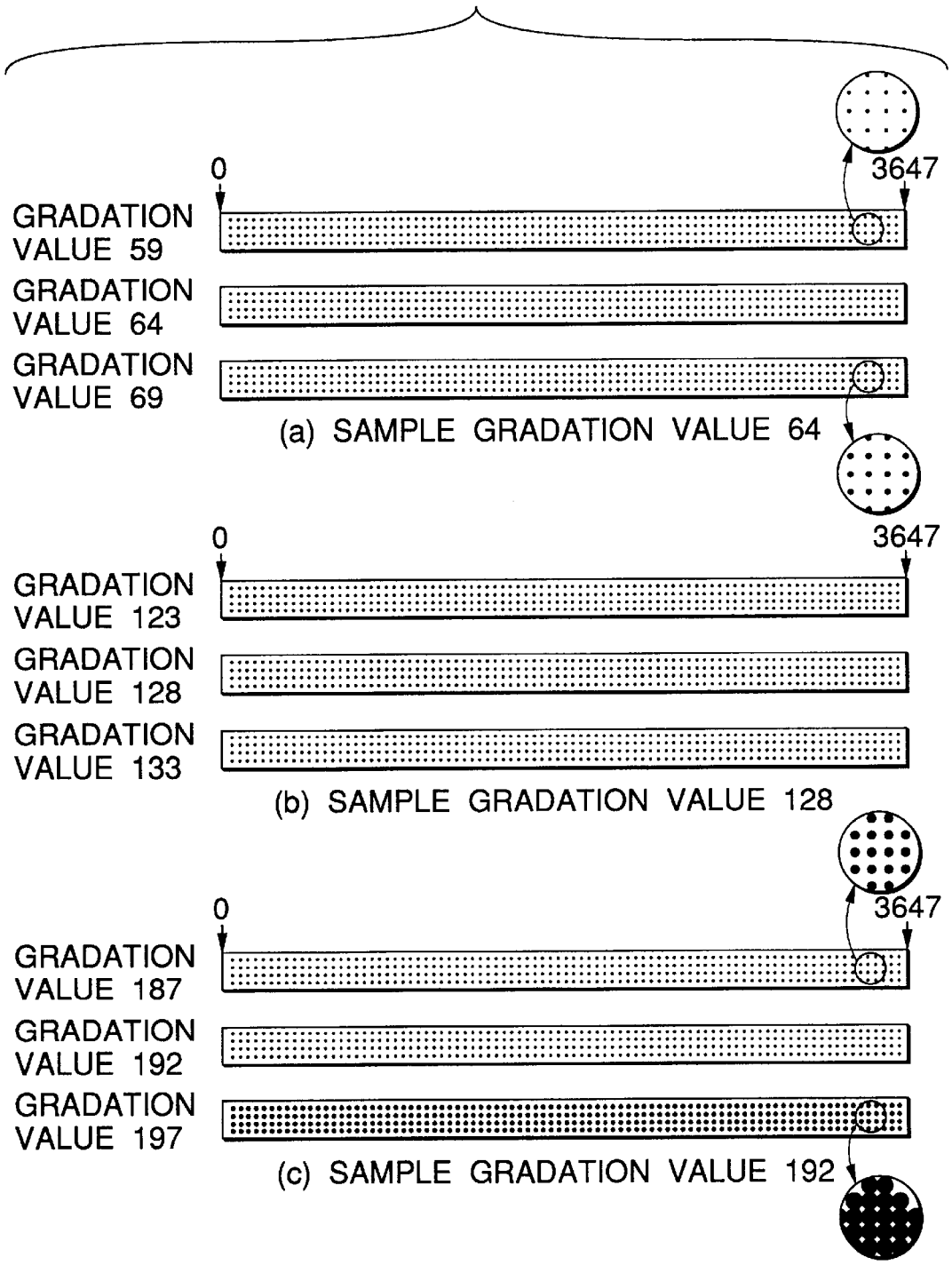
FIG. 6 is a view showing belt-like pattern portions recorded at set gradation values with respect to sample gradation values.

First, in step S1, belt-like image patterns shown in FIG. 6 are recorded at predetermined-gradation values respectively by the recording portion 20. For example, in the case of image data of 256 gradations, the three stages of 64, 128 and 192 which are intermediate values between 0 and 255 are selected as sample gradation values Di (i=1 to 3) (in which D0=0 and D4=255). For each of the three sample gradation values D1, D2 and D3 except the minimum and maximum gradation values D0 and D4, the gradation value Di and gradation values Di±5 obtained by addition/subtraction of a predetermined gradation width (for example, 5 gradations) to/from the gradation value Di, that is, three gradation values Dai(=Di−5), Dbi(=Di) and Dci(=Di+5) in total are set. That is, a set gradation value group consisting of three gradation values is set in correspondence with one sample gradation value. Such set gradation value groups are set for three sample gradation values, so that three groups, that is, nine gradation values are set in total.

Although this mode has been described upon the case where the sample gradation values are set as three stages (D1, D2 and D3), the present invention is not limited thereto but may be applied to the case where the number of stages is reduced for simplification of calculation or to the case where the number of stages is increased for improvement of accuracy in setting the correction values. Although the predetermined gradation width is selected to be 5 gradations, this value may be preferably set so as to be suitably changed in accordance with image data used. Further, either addition or subtraction of a predetermined gradation width may be set so that the two gradation values of a predetermined-gradation value and a gradation value obtained by addition or subtraction are used as one group for performing processing after that. Further, a plurality of gradation values (for example, five gradation values in total, that is, a predetermined-gradation value Di, Di±5, Di±10) with a sample gradation value as its center may be set so that the plurality of gradation values are used as one group for performing processing. In any case, the aforementioned values are preferably determined on the basis of balance between correction accuracy and processing time.

(a) of FIG. 6 shows results of recording in the first main scanning direction (heating resistor position H=0 to 3647) of the recording apparatus at three set gradation values corresponding to a sample gradation value D1. Similarly, (b) of FIG. 6 and (c) of FIG. 6 show results of recording corresponding to sample gradation values D2 and D3 respectively. Although printing density in each of belt-like pattern portion is ideally uniform and equivalent to the set gradation value as the gradation value of the image data, the actual recording results may show that the printing density is often shifted from density corresponding to the set gradation value or varies in accordance with the recording position to thereby bring density irregularity in the first main scanning direction.

The case where the sample gradation value is 64 (D1=64) will be described below as an example for simplification of description. Assuming now that set gradation values expressing gradation values of image patterns as a correction reference are Da1=59(=D1−5), Db1=64(=D1) and Dc1=69 (=D1+5) respectively, then patterns at the set gradation values Da1, Db1 and Dc1 are recorded successively on the whole surface (the maximum recording width of the thermal head having 3648 heating resistors) of the thermal head 61 in the first main scanning direction so as to be shaped like belts respectively, as shown in FIG. 7.

Figure 7:
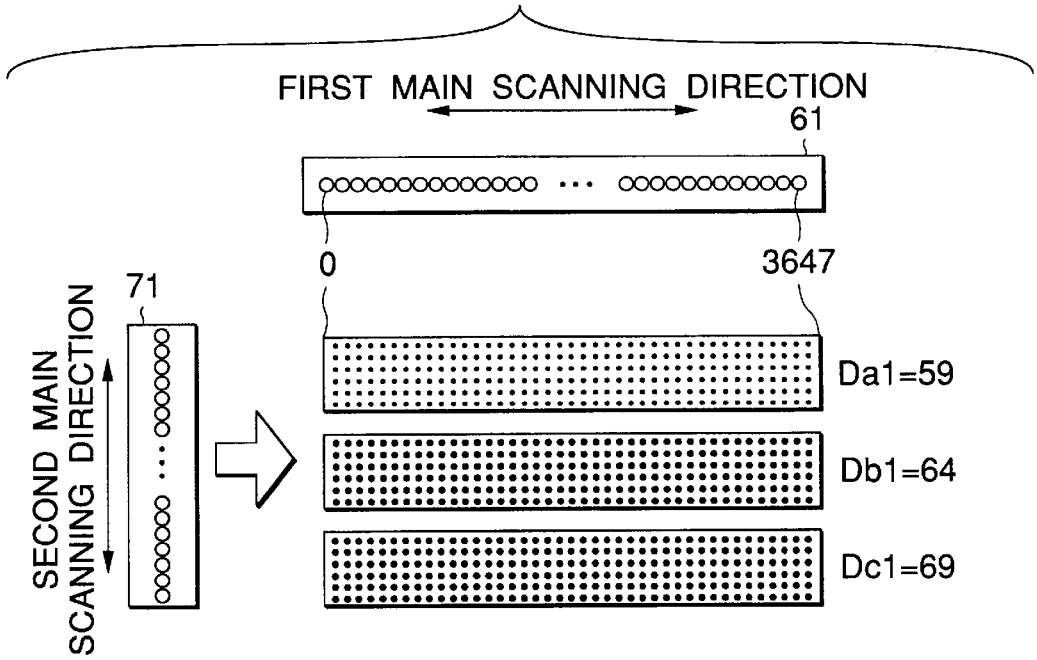
FIG. 7 is a view showing the relation between the first main scanning direction of the recording apparatus and the second main scanning direction of the scanner.

Then, in step S2, a scanner 71 having a line sensor shown in FIG. 7 is disposed so that the second main scanning direction of the scanner 71 is substantially perpendicular to the first main scanning direction of the thermal head 61, and the scanner 71 scans in the direction of the arrow as the first main scanning direction of the thermal head 61 to detect respective printing-density values La(H), Lb(H) and Lc(H) of the belt-like pattern portions against all pixels (H=0 to 3647 pixels on the assumption that the detection resolution of the scanner coincides with the interval of arrangement of the heating resistors). In this occasion, each of the printing-density values La(H), Lb(H) and Lc(H) is obtained by averaging printing-density values (printing-density values in the same H position) against several pixels in the belt width of each belt-like pattern. In this manner, not only variations in sensitivity characteristic of respective detection elements of the scanner are averaged but also printing-density values can be detected accurately even in the case where, for example, white missing dots or black dots are printed on the belt-like pattern or dust, or the like, is deposited on the belt-like pattern.

In the case where the detection resolution of the scanner does not coincide with the interval of arrangement of the heating resistors, a resolution changing process can be performed by a known method. Further, because it is difficult to dispose the scanner in a perpendicular position strictly, a position detection pattern may be preferably disposed in the printing image in advance so that this pattern is used as a reference for performing image rotation and the resolution changing process.

Figure 8:
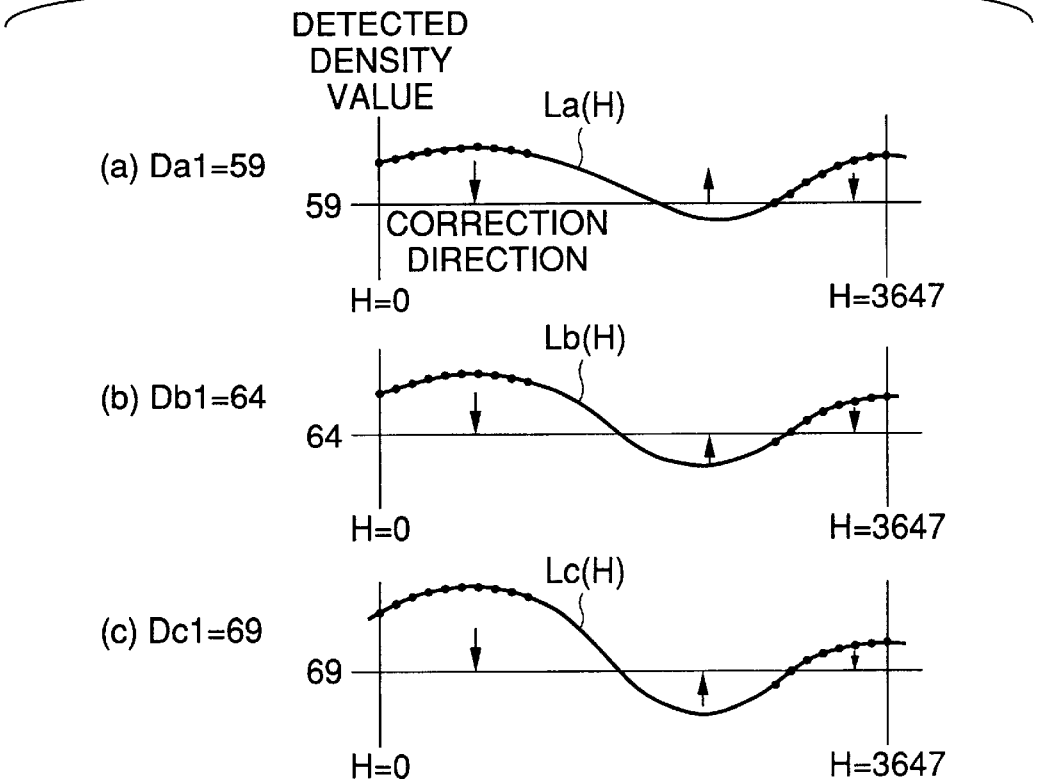
FIG. 8 is a graph showing distributions of detected values of printing densities at respective set gradation values.

For example, the printing-density values La(H), Lb(H) and Lc(H) obtained by scanning with the scanner 71 exhibit density distributions as shown in FIG. 8. As shown in FIG. 8, the printing-density values La(H), Lb(H) and Lc(H) are displaced from the set gradation values Da1, Db1 and Dc1 respectively in terms of absolute values. The quantity of displacement varies in accordance with each pixel and in accordance with each set gradation value. Accordingly, correction processes are required in accordance with pixels and gradations in order to obtain uniform density corresponding to the set gradation value.

In step S3, averages LaAV, LbAV and LcAV of the printing-density values La(H), Lb(H) and Lc(H) obtained by scanning with the scanner are obtained against all pixels.

Then, in step S4, correction coefficients Ri (in this case, i=1) are obtained. The correction coefficients Ri which are the ratios of gradation values to printing-density values in neighbors of sample gradation values, are calculated by the expression (1).

$$Ri=(Dci-Dai)/(LcAV-LaAV) \quad (1)$$

Figure 9:
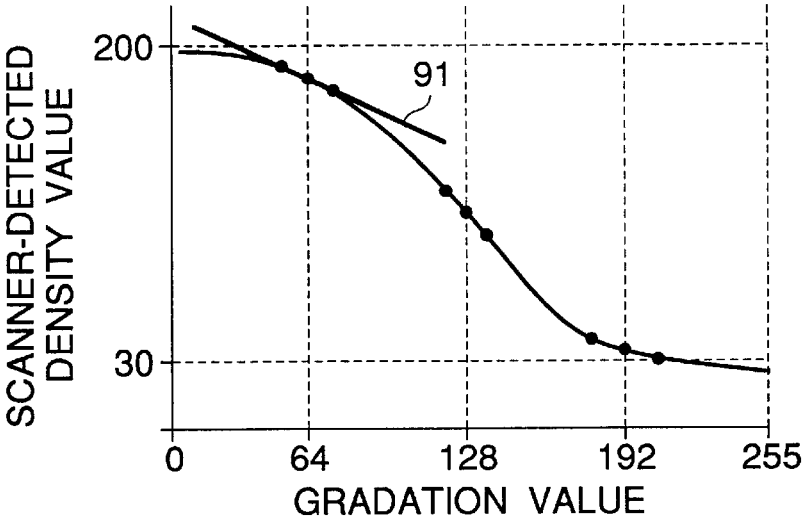
FIG. 9 is a graph showing the relation of the density value detected by the scanner with respect to each set on value.

FIG. 9 shows the relation of the density value detected by the scanner with the set gradation value. In FIG. 9, the correction coefficient Ri expresses the change of the density value detected by the scanner in a neighbor of each sample gradation value, that is, the correction coefficient Ri expresses an inclination 91.

Then, in step S5, gradation correction values Xi(H) for correcting printing-density values appropriately are calculated by the expression (2) with Ri obtained in the step S4.

$$Xi(H)=Di-\{LbAV-Lb(H)\}Ri \quad (2)$$

In this manner, printing-density correction values against all pixels at a sample gradation value D1=64 are obtained.

The aforementioned process for calculating gradation correction values Xi(H) is carried out upon all the sample gradation values Di (i=1, 2, 3) (steps S6 and S7). When scanning is performed relatively along the longitudinal direction of the belt-like pattern by the scanner to detect printing density to thereby calculate gradation correction values with correction coefficients on the basis of the ratios of the obtained printing-density values to gradation values, gradation correction values can be determined accurately in the aforementioned manner even in the case where, for example, a different type of scanner is used or a scanner irregular in sensitivity characteristic in the second main scanning direction is used.

Figure 10:
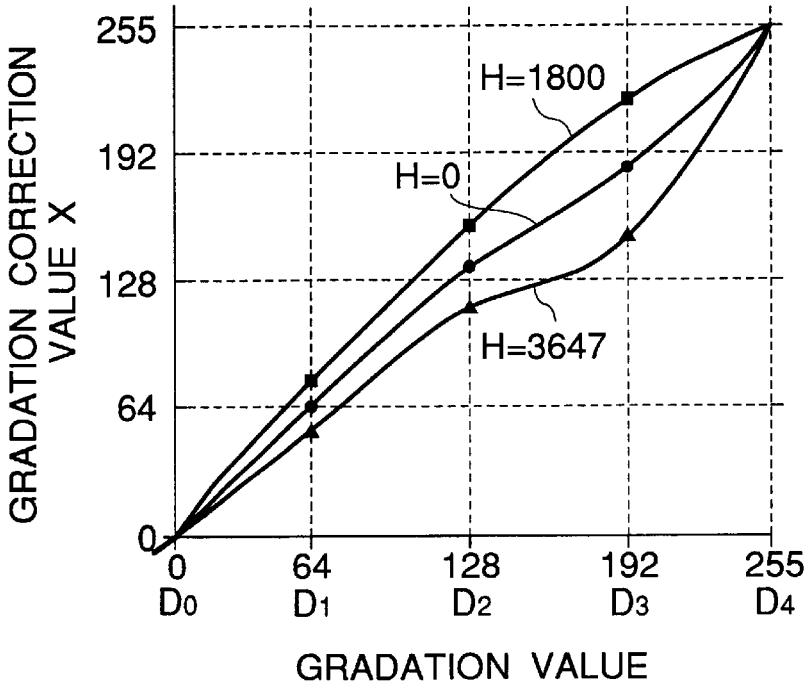
FIG. 10 is a graph showing gradation correction values versus gradation values of input image data.

After gradation correction values Xi(H) corresponding to all sample gradation values Di (i=1, 2, 3) are calculated, gradation correction values corresponding to respective sample gradation values Di are obtained for all pixels as shown in FIG. 10. FIG. 10 shows gradation correction values only for three pixels H=0, 1800 and 3647. Incidentally, gradation correction values corresponding to sample gradation values D0 and D4 are set to be 0 and 255, respectively, for all pixels.

Then, in step S8, gradation correction values x(H) for all gradations are obtained approximately on the basis of the discrete gradation correction values Xi(H) obtained in the step S5 correspondingly to respective sample gradation values. Specifically, gradation correction values are interpolated into between respective sample gradation values, for example, by a linear interpolation process, a spline interpolation process or a general interpolation process using an arbitrary function on the basis of gradation correction values X0(0), X1(0), X2(0), X3(0) and X4(0) for one and the same pixel (for example, pixel of H=0), so that gradation correction values x(H) for all gradations are obtained. By the interpolation process, gradation correction values can be obtained with practically sufficient accuracy, so that the process for calculating gradation correction values can be simplified.

Then, in step S9, a correspondence table showing gradation correction values x(H) corresponding to all gradation values, that is, all gradations of from 0 to 255 for all pixels in the first main scanning direction of the recording apparatus, that is, pixels of from H=0 to 3647 as shown in FIG. 11 is stored in the correction value table storage portion 2. Here, it is necessary to convert the gradation correction values as integers because the gradation correction values are set as gradation values of an image directly. Examples of means for converting a number as an integer are the following two methods.

A first method is a method for rounding a decimal to the nearest integer number simply.

A second method is a method for performing conversion on the basis of a probability means. When, for example, a gradation correction value inclusive of decimal places is 128.5, the correction value is regarded as 128 in the case where the line position in the subsidiary scanning direction is an even-numbered line position, and the correction value is regarded as 129 in the case where the line position in the subsidiary scanning direction is an odd-numbered line position. A specific method used for this process is as follows. First, all gradation correction values inclusive of decimal places are quadrupled and decimal places of the quadrupled correction values are cut. Accordingly, the gradation range of gradation correction values of from 0 to 255 are extended to a gradation range of from 0 to 1020. That is, a correction value table shown in FIG. 12 is generated so that first, printing gradation data of gradation correction values of from 0 to 255 are converted into gradation data of from 0 to 1020.

Then, values of 0 to 3 determined on the basis of the printing position are used as addition values which are added to data of 0 to 1020, so that the gradation correction values are converted into values in a gradation range of from 0 to 1023.

Then, each of the values is divided by 4 and decimal places are cut. For example, the aforementioned addition values may be determined by use of a matrix shown in FIG. 13. By the aforementioned process, gradation correction values are converted into integers.

In this occasion, p shown in FIG. 13 corresponds to the remainder when the heater position H is divided by 4, and q corresponds to the remainder when the subsidiary scanning line position is divided by 4. When, for example, the heater position is 105th order and the subsidiary scanning line position is 63rd order, the relations p=1 and q=3 are obtained. From FIG. 13, the addition value is determined to be 1.

Assume now that the gradation correction value is 128.3, then the conversion of the correction value into an integer in the aforementioned manner is as follows. First, 128.3 is quadrupled and decimal places of the resulting number are cut, so that the correction value is converted into 513. Then, an addition value in accordance with the printing position with reference to FIG. 13 is added to the converted correction value. After addition, the resulting number is divided by 4 and decimal places are cut.

That is, the correction value is converted into 128 in the printing position exhibiting the addition value of 0, the correction value is converted into 128 in the printing position exhibiting the addition value of 1, the correction value is converted into 128 in the printing position exhibiting the addition value of 2, and the correction value is converted into 129 in the printing position exhibiting the addition value of 3. Because the probabilities that addition values of 0 to 3 will appear are equal, the correction value of 128.3 is converted into 128 in a probability of 3/4 and into 129 in a probability of 1/4.

Although the expressions "to quadruple" and "to divide by 4" are used in the above description, it is unnecessary to perform such multiplication and division actually because of only difference in decimal places in binary notation. When, for example, lower 2 bits of a value of 0 to 1023 expressed in 10 bits are neglected (not connected in terms of hardware) and upper 8 bits of the value are used, a state equivalent to the state in which "the value is divided by 4 and decimal places of the resulting number are cut" is obtained. Accordingly, numbers can be converted into integers quickly even in the case where the quantity of data is enormous.

The step of forming an image of input image data will be described below.

First, in step S10, image data from the outside are inputted into the image correction control portion 1. For example, image data stored in a recording medium such as a photomagnetic disk, a floppy disk, or the like, are read out or image data are taken in by communication with an external apparatus, so that the image data are inputted.

Then, in step S11, gradation correction values corresponding to pixel and gradation values of the input image data are read with reference to the correction value table stored in the correction value table storage portion 2 with respect to the pixel values of the input image data. The gradation correction values are supplied to the image memory 3 so that corrected image data are constructed on the image memory 3.

Then, in step S12, the corrected image data stored in the image memory 3 are supplied to the thermal head 61 in accordance with a recording instruction of the image correction control portion 1, so that the corrected image data are formed on a heat-sensitive film A.

The recording image constituted by the thus formed corrected image data is obtained as a high-quality image free from density irregularity because density irregularity in the first main scanning direction of the thermal head 61 is corrected appropriately with respect to all pixels and all gradation values.

As described above, in the mode for carrying out the present invention, the scanner is moved in the first main scanning direction of the thermal head to thereby detect printing density recorded at a predetermined-gradation value. Accordingly, density irregularity in the second main scanning direction can be measured in the same condition, so that printing density can be detected accurately. Further, density values detected by a plurality of detection elements contained in the scanner are averaged to obtain a printing-density value. Accordingly, detection accuracy can be improved more greatly. Accordingly, even in the case where sensitivity characteristic in the second main scanning direction of the scanner is irregular or the scanner is not calibrated, density irregularity appearing in the first main scanning direction of the thermal head can be corrected accurately.

According to the present invention, printing densities of belt-like patterns, or the like, recorded at predetermined gradations are detected while a line sensor is relatively moved along the first main scanning direction of a line head. As a result, not only detection errors of the printing densities can be reduced but also gradation correction values can be stably detected without influence of individual characteristics of different line sensors, or without influence of sensitivity characteristic depending on different detection elements of a line sensor. Accordingly, density irregularity can be corrected accurately.

Further, conditions for correction of discretely set gradation values are obtained by interpolation for all gradations. Accordingly, the correction conditions can be set easily with practically sufficient accuracy without detailed detection of printing densities for all gradations.

What is claimed is:

1. A method for correcting density irregularity in image recording using a line head, comprising the steps of:

printing a belt-like pattern at a pre-determined gradation value in a first main scanning direction which corresponds to a scanning direction of said line head;

moving a line sensor relatively along said first main scanning direction while aligning a second main scanning direction, which corresponds to a scanning direction of said line sensor, with a subsidiary scanning direction, being substantially perpendicular to said first main scanning direction, to detect a printing-density value of said belt-like pattern;

obtaining a correction condition for each pixel position based on detected said printing-density value and said predetermined-gradation value; and correcting image data for image recording on the basis of said correction condition, wherein:

said belt-like pattern includes a plurality of belt-like pattern portions printed at least with two gradation values which are selected in proximity to said predetermined gradation value; and averages of printing-density values are obtained from said plurality of belt-like pattern portions and said correction condition is set based on change ratios of said averages of printing-density values to said gradation values of the belt-like pattern portions.

2. A method for correcting density irregularity according to claim 1, wherein:

printing a plurality of said belt-like pattern at predetermined-gradation values in a first main scanning direction;

each of said predetermined-gradation values is any one of said gradation values obtained by dividing a gradation range, which covers up to the maximum gradation value, into a plurality of equal stages; and correction conditions for all gradations are set by interpolation based on individual correction conditions set for said respective stages.

3. A method for correcting density irregularity according to claim 2 wherein an image is recorded, by a thermal head, on a thermal transfer recording material having a substantially transparent heat-sensitive ink layer, said ink layer containing 30 to 70 parts by weight of pigment and 25 to 60 parts by weight of amorphous organic high-molecular polymer having a softening point of from 40° C. to 150° C., said ink layer having a thickness of from 0.2 $\mu$m to 1.0 $\mu$m, 70% or more of pigments contained in said heat-sensitive ink layer having particle sizes not larger than 1.0 $\mu$m, optical reflection density of a transfer image being not lower than 1.0 when said thermal transfer recording material is formed on a white support.

4. An image recording apparatus comprising:

a correction value table storage portion for storing a correction value table for a gradation value correction based on printing-density values of image patterns printed by a method according to claim 2, an image correction control portion for controlling correction of image data; and an image memory for storing corrected image data based on said correction value table.

5. An image recording apparatus comprising:

a correction value table storage portion for storing a correction value table for a gradation value correction based on printing-density values of image patterns printed by a method according to claim 1;

an image correction control portion for controlling correction of image data; and an image memory for storing corrected image data based on said correction value.

6. A method for correcting density irregularity according to claim 1 wherein an image is recorded, by a thermal head, on a thermal transfer recording material having a substantially transparent heat-sensitive ink layer, said ink layer containing 30 to 70 parts by weight of pigment and 25 to 60 parts by weight of amorphous organic high-molecular polymer having a softening point of from 40° C. to 150° C., said ink layer having a thickness of from 0.2 $\mu$m to 1.0 $\mu$m, 70% or more of pigments contained in said heat-sensitive ink layer having particle sizes not larger than 1.0 $\mu$m, optical reflection density of a transfer image being not lower than 1.0 when said thermal transfer recording material is formed on a white support.

7. A method for correcting density irregularity in image recording using a line bead, comprising the steps of:

printing a belt-like pattern at a pre-determined gradation value in a first main scanning direction which corresponds to a scanning direction of said line head;

moving a line sensor relatively along said first main scanning direction while aligning a second main scanning direction, which corresponds to a scanning direction of said line sensor, with a subsidiary scanning direction, being substantially perpendicular to said first main scanning direction, to detect a printing-density value of said belt-like pattern;

obtaining a correction condition for each pixel position based on detected said printing-density value and said predetermined-gradation value; and correcting image data for image recording on the basis of said correction condition, wherein:

said belt-like pattern includes first and second belt-like pattern portions which are printed at a first gradation value as said pre-determined-gradation value and at a second gradation value in proximity to said first gradation value respectively; and averages of printing-density values are obtained for said first and second belt-like patterns and said correction condition is set based on a ratio of the difference between said averages to the difference between said first and second gradation values.

8. A method for correcting density irregularity according to claim 7, wherein:

printing a plurality of said belt-like pattern at predetermined-gradation values in a first main scanning direction;

each of said predetermined-gradation values is any one of said gradation values obtained by dividing a gradation range, which covers up to the maximum gradation value, into a plurality of equal stages; and correction conditions for all gradations are set by interpolation based on individual correction conditions set for said respective stages.

9. An image recording apparatus comprising:

a correction value table storage portion for storing a correction value table for a gradation value correction based on printing-density values of image patterns printed by a method according to claim 8, an image correction control portion for controlling correction of image data; and an image memory for storing corrected image data based on said correction value table.

10. A method for correcting density irregularity according to claim 8, wherein an image is recorded, by a thermal head, on a thermal transfer recording material having a substantially transparent heat-sensitive ink layer, said ink layer containing 30 to 70 parts by weight of pigment and 25 to 60 parts by weight of amorphous organic high-molecular polymer having a softening point of from 40° C. to 150° C., said ink layer having a thickness of from 0.2 $\mu$m to 1.0 $\mu$m, 70% or more of pigments contained in said heat-sensitive ink layer having particle sizes not larger than 1.0 $\mu$m, optical reflection density of a transfer image being not lower than 1.0 when said thermal transfer recording material is form ed on a white support.

11. An image recording apparatus comprising:

a correction value table storage portion for storing a correction value table for a gradation value correction based on printing-density values of image patterns printed by a method according to claim 7, an image correction control portion for controlling correction of image data; and an image memory for storing corrected image data based on said correction value.

12. A method for correcting density irregularity according to claim 7 wherein an image is recorded, by a thermal head, on a thermal transfer recording material having a substantially transparent heat-sensitive ink layer, said ink layer containing 30 to 70 parts by weight of pigment and 25 to 60 parts by weight of amorphous organic high-molecular polymer having a softening point of from 40° C. to 150° C., said ink layer having a thickness of from 0.2 $\mu$m to 1.0 $\mu$m, 70% or more of pigments contained in said heat-sensitive ink layer having particle sizes not larger than 1.0 $\mu$m, optical reflection density of a transfer image being not lower than 1.0 when said thermal transfer recording material is formed on a white support.

* * * * *